United States Patent [19]

Brooks

[11] 4,151,706

[45] May 1, 1979

[54] YARN STRIPPER

[75] Inventor: Frank E. Brooks, Seneca, S.C.

[73] Assignee: Platt Saco Lowell Limited, United Kingdom

[21] Appl. No.: 875,011

[22] Filed: Feb. 3, 1978

[51] Int. Cl.[2] ..... D01H 11/00

[52] U.S. Cl. ..... 57/303; 15/256.51; 57/299; 83/924

[58] Field of Search ..... 57/34.5, 34 TT; 15/256.51; 83/924

[56] References Cited

U.S. PATENT DOCUMENTS

| | | | |
|---|---|---|---|
| 2,323,907 | 7/1943 | Harriss et al. | 15/256.51 X |
| 2,820,337 | 1/1958 | Warren, Jr. | 15/256.51 X |
| 2,932,149 | 4/1960 | Ingham, Jr. | 57/34 TT |
| 3,312,051 | 4/1967 | Schumann et al. | 57/34.5 |
| 3,631,663 | 1/1972 | Krauss et al. | 57/34 TT |

*Primary Examiner*—Charles Gorenstein
*Attorney, Agent, or Firm*—Donald H. Feldman

[57] ABSTRACT

Disclosed is a plate-like yarn stripper device for use in removing staple fiber yarns from rotatable elements of circular cross-section, such as in the removal of yarn wraps underwound beneath a spindle blade to anchor the yarn threadline in the doffing and donning of cops on a ring spinning frame. The stripper is formed with a central hole defining stripping edges at a surface of the plate, these edges being spaced from the yarn-wound element by a prescribed distance such that when the element is rotated the wound yarn will buffet the edges and be abraded, weakened and cut or otherwise severed in the stripping action. Personnel safety is enhanced in use of the stripper by the absence of peripheral sharp edges, bristles or other abrasive external surfaces.

24 Claims, 8 Drawing Figures

YARN STRIPPER

FIELD OF THE INVENTION

Figure 1:
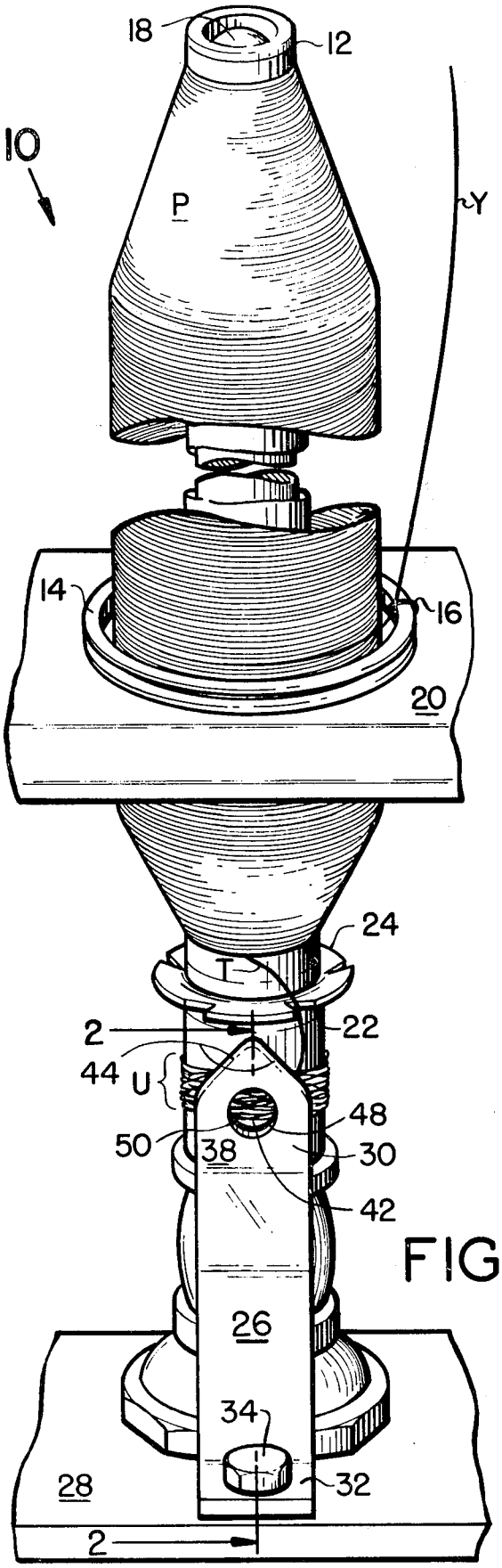

The invention relates to a device for removing yarn wraps from a rotatable element of circular cross-section. More particularly, it relates to such a device especially suited for removing yarn wraps, known as "underwindings," from a rotatable element of a ring spinning spindle assembly positioned below its spindle blade.

BACKGROUND OF THE INVENTION

The prior art is replete with devices used to cut, abrade or otherwise remove yarn wraps from cots, and underwindings from spindle assemblies. They include knife blades with sharp, externally peripheral knife edges, abrasive-surfaced elements, metal-toothed or bristled brushes and the like, which either are fixed in spaced adjacency to the rotatable element about which the wraps reside, or may be manually or mechanically moved to and held in such spaced adjacency. The need for removal of the yarn wraps may be to strip a cot of waste yarn, or to remove underwindings which otherwise would interfere with proper operation of a spindle assembly in its yarn spinning function or of adjacent assemblies. Such devices may be augmented by suction devices to remove severed yarn and fly produced in the stripping.

With the advent of new types of staple yarn, such as from diverse man-made fibers and their blends with natural fibers, the problem of the removal of yarn wraps has become more difficult to solve. Many types of such yarns have extremely high tenacities and tensile strengths, making them quite difficult to abrade and cut. These yarns have had the effect of quickly dulling knife edges and rapidly wearing abrasive, abrading implements and materials. A further effect observed is that such yarns seem to require longer and still longer intervals of time to strip them. A yet further observed effect with yarns made of thermoplastic materials is the melt fusing of their fibers due to high frictional heat developed during the stripping operation making the latter extremely difficult. In those devices employing a fixed device, such as a knife blade, constant and repeated buffetings by the yarn wraps as the element rotates not only dulls the cutting or abrading surface but wears the surface which effect quickly enlarges the distance between such surface and the element to permit larger and larger accumulations of yarn wraps to remain on the element. Further, if the device is adjustably fixed, the buffetings act to flex the device and loosen it and move it away from the rotatable element and its yarn wraps producing a similar effect to that just mentioned. When sufficiently loosened, the device is rendered inoperative, and requires positional readjustment and rigid re-fixing. All of these effects tend to mitigate against the prime advantage which one seeks in employing a fixed stripper device, that of automatically removing yarn wraps without the need for intermittant manual stripping or readjustment.

A further problem with prior art stripping devices is one of safety, and possible injury to persons adjusting or fixing the devices by an incautious coming into contact with their external peripheral knife or abrading surfaces.

OBJECTS OF THE INVENTION

It is to the remedy of the aforesaid problems that the present invention is directed, such being an object.

Another object of the invention is to provide a stripper device which automatically and reliably strips yarn wraps from an element while it rotates, regardless of the type or twist of the yarn.

A further object of the invention is to provide a stripper device which is long-lived and employs a combination of abrading and cutting without the use of an externally peripheral knife edge or a rapidly wearing abrading surface.

These and yet other desirable objects of the invention shall become evident to one skilled in the art through a reading of the detailed explanations which follow.

SUMMARY OF THE INVENTION

It has now been found that the foregoing objects may be satisfied and the stated problems be solved or assuaged by use of a rigid stripper device formed with a central hole, which device is fixed rigidly adjacent to the area of yarn wraps accumulation such that the confronting edges of its hole are spaced from the rotatable element a distance which corresponds to the maximum depth of yarn wraps desired or permissible.

THE DRAWINGS

Figure 2:
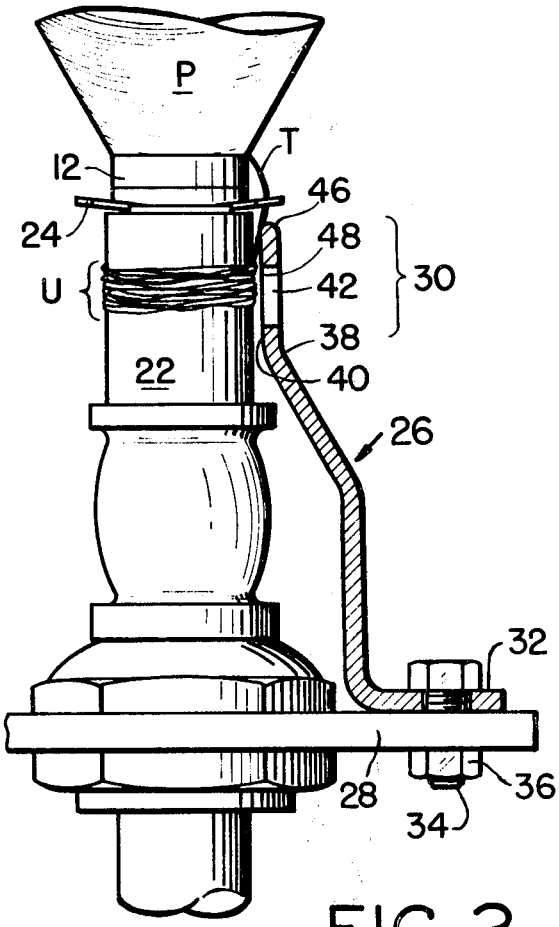
Figure 3:
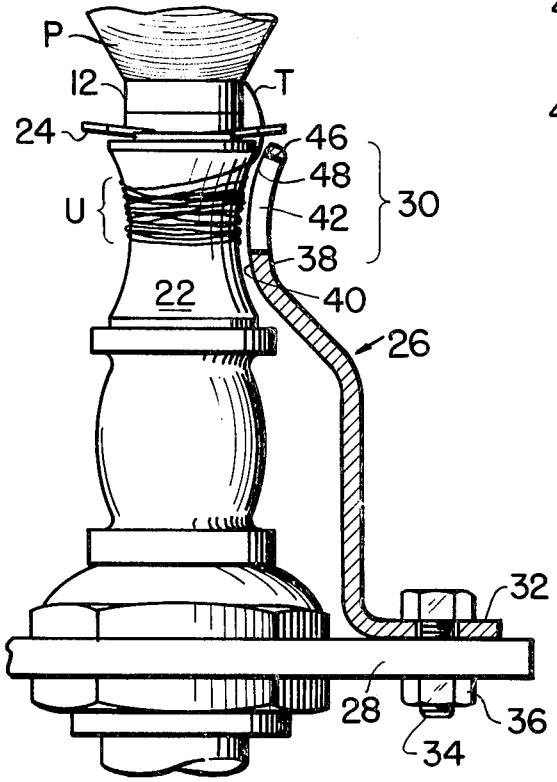
Figure 5:
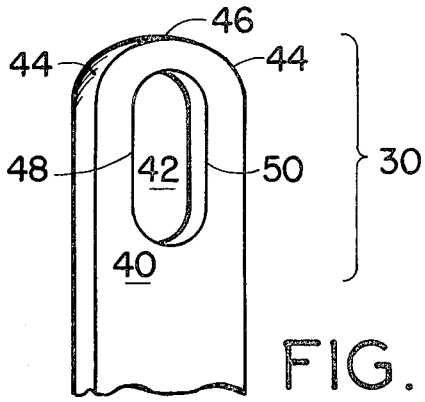
Figure 6:
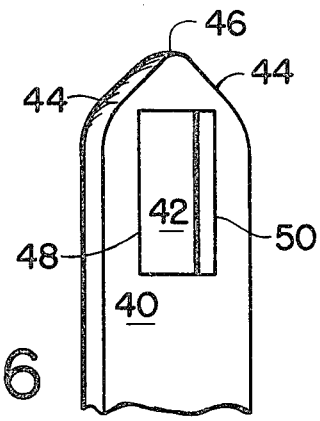
Figure 7:
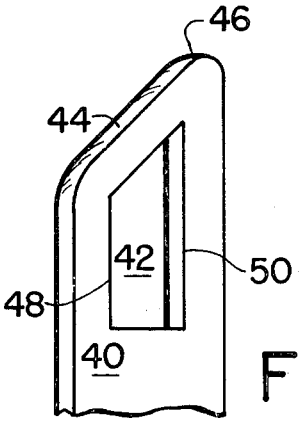
Figure 8:
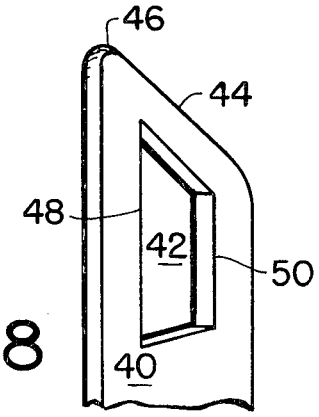
Figure 4:
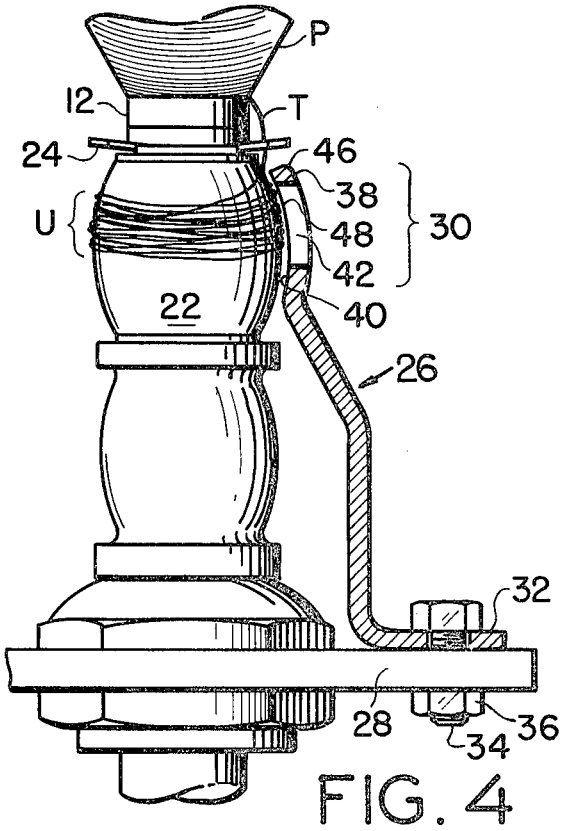

The nature of the invention, its advantages and operation may better be understood through the following description of its preferred embodiments when taken in conjunction with the appended drawings, in which:

FIG. 1, in front perspective view partially broken away, shows a stripper device of the invention, with hemicircular stripping edges defining its central cylindrical hole on an upper flat plate portion, mounted upon a ring spinning spindle assembly of a conventional spinning frame;

FIG. 2, shows in fragmentary side perspective view the assembly of FIG. 1, with the mounted stripper device thereof in section generally taken along line 2—2 of FIG. 1;

FIG. 3, also in similar fragmentary side perspective view of a spindle assembly, shows in section another embodiment of the stripper device of the invention having a convex confronting surface complementary to a concave rotatable surface of the assembly on which yarn wraps accumulate;

FIG. 4, in similar view to that of FIG. 3, shows yet another embodiment of the stripper device having a concave surface complementary to the convex surface of the assembly on which yarn wraps accumulate;

FIG. 5, in fragmentary rear elevation shows the upper flat confronting surface of a stripper device of the invention, formed with an oblong central hole defined by straight or linear stripping edge portions joined by arcuate edge portions, and having a rounded-sloped top portion;

FIG. 6, in similar fashion to the stripper portion shown in FIG. 5, shows a quadrilateral hole through the stripper device having a rectangular cross-section and a rounded, double-sloped peripheral top portion;

FIG. 7, in similar fashion to that of stripper portions of FIGS. 5 and 6, shows a non-rectangular quadrilateral hole through the stripper device and a rounded, single right-handed top slope to the stripper's upper peripheral edge surfaces; and FIG. 8, in analagous fashion to the showing of FIG. 7, in yet another embodiment of the stripper device the rounded single top slope is shown to the left and the hole is in the form of a different quadrilateral.

PREFERRED EMBODIMENTS

Referring to FIGS. 1 and 2, in a ring and traveller yarn spinning machine (not otherwise shown), a plurality of ring and traveller yarn spinning spindle assemblies, one of which is shown is generally designated 10, are arranged in spaced longitudinal array on each side of the machine. Thereby, a yarn Y is spun onto a cop 12 by means of a stationary ring 14 and a rotating traveller 16 thereon in a winding and twisting action which produces either an "S" or a "Z" twist in yarn Y, depending upon the direction of rotation of traveller 16, and cop 12. The latter is mounted upon a similarly rotating spindle blade 18 of assembly 10. For spinning yarn Y, ring 14 mounting traveller 16 in turn is fixedly mounted in a recess in a ring rail 20 of the machine. Rail 20 during spinning vertically reciprocates in a prescribed, timed, sequential pattern of strokes from a point below the top of cop 12 to a point above the bottom of cop 12 to produce a multitude of overwinding layers of yarn thereon. When cop 12 is filled with yarn Y to a prescribed capacity, a yarn "package" P is produced with a predetermined shape, exemplarily shown as a "double tapered" package. Thereupon, rail 20 is manually or automatically lowered to a point beneath spindle blade 18 and adjacent to a non-driving, rotating member 22 of assembly 10, and is latched there. Member 22 then receives wraps of yarn Y known as underwindings, as spinning continues during the latched period, to anchor yarn Y thereto, thus to establish a continuous threadline of yarn Y from where yarn sliver or roving issues from the front delivery rolls of a drafting unit (not shown) above assembly 10 downward through traveller 16 and onto member 22.

Blade 18 and member 22 are braked to a stop and package P with cop 12 is removed from blade 18 in a lifting motion known as "doffing." The innermost underlayer of yarn Y of package P is connected to previous underwindings with its threadline T passing over a cutting collar 24 mounted between the bottom of blade 18 and above member 22 of assembly 10. In so lifting, threadline T is broken and package P is removed. Another cop 12 devoid of yarn is then placed upon blade 18 and seated above collar 24 for subsequent filling with yarn Y, in an action known as "donning." Blade 18 and member 22 are unbraked, and rail 20 in unlatched and raised to an elevation between the top and bottom of empty cop 12. In the now continued spinning process, initial wraps of yarn Y are twisted and wound about cop 12 to establish a fresh threadline T between the underwindings on member 22 and the initial wraps of yarn Y on cop 12. Rail 20 then pursues its prescribed, timed, sequential pattern of vertically reciprocatory strokes in the build of another yarn package P.

Repeatedly, in this manner underwindings accumulate about member 22 and must be removed.

According to the invention, an underwindings stripper device 26 is rigidly mounted upon a non-moving frame element of the machine, like the spindle rail 28, such that its upper portion 30 faces and is in spaced adjacency to member 22 containing the underwindings U. Device 26 is fixed in such position at its lower mounting portion 32, which exemplarily is in the form of a horizontal flange 32, by a bolt 34 rigidly joining spindle rail 28 and flange 32 and which may be secured by a locking nut 36 (FIG. 2) to the underside of rail 28. Device 26 desirably is in the form of a rigid plate having a substantial thickness such as that shown, which desirably may be at least 1/32nd of an inch (0.8 mm) thick to at most about ½ inch (12.7 mm) thick measured from its confronting surface 40, facing member 22 (FIG. 2), to its opposed outwardly facing surface 38. Upper portion 30 is formed with a central hole 42 therethrough from surface 38 to surface 40, which may be punched, drilled, or otherwise cut. Hole 42 may be defined at surfaces 38 and 40 by the shapes, sizes and separations of the edge portions thereof at each surface or by the shapes, sizes and separations of the inner wall portions between surfaces 38 and 40.

As a practical matter, one may define the size of hole 42 by the distances of separation of the edge portions 48 and 50 (FIG. 2) at confronting surface 40 facing yarn wraps U to the surface of member 22, which edge portions 48 and 50 extend transversely to the direction of layering of underwindings U and generally in the direction of the axis of rotation of member 22. Thus, in FIGS. 1 and 2, cylindrical hole 42 having a circular edge may be thought of as being comprised of two hemicircular opposing edge portions 48 and 50 vertically extending and transverse to the horizontally extending wraps U, their separation and the size of hole 42 being defined by the diameter distance therebetween. Edge portions 48 and 50 are the yarn stripping edges of this embodiment of present device 26. In general, and for most applications, the minimum separation between opposing yarn stripping edges of a device of the invention would correspond to about 1/10th of the radius of the rotatable member, and a practical maximum distance of separation would correspond to about one radius of such member. Stripping edge portions, as a practical matter, should extend in the aforesaid transverse directions within the range of at least a distance corresponding to the expected width of wraps U accumulated as measured transverse to their direction of layering on the rotatable member, and at most a distance corresponding to the axial length of the rotatable member.

In an alternate unshown embodiment, hole 42 may be in the form of a sectioned cone, wherein the circular hole edge at the confronting surface 40 may have either a larger or smaller diameter than that at the other outwardly facing surface 38, with the inner walls of the hole therebetween being thought of as bevelled.

Device 26 with a flat upper plate portion 30, as in FIGS. 1, 2, and 5 to 8, is particularly suited for use with a cylindrical rotatable member 22. However, where rotatable member 22 is not cylindrical, as in FIGS. 3 and 4, one desirably may contour portion 30 to complement the surface contours of member 22. For example, in FIG. 3, member 22 has a concave peripheral contour, and upper portion 30 has its confronting surface 40 in a complementary convex contour. In FIG. 4, where member 22 has a convex peripheral contour, portion 30 has its confronting surface 40 of a complementary concave contour. For certain special applications, unshown, surface 40 may have an anti-complementary contour to that of member 22.

The orifice nature of hole 42, by passing completely through yarn confronting portion 30, serves several functions. It acts as an exit for fragments of yarn and fly removed from wraps U, and appears to be self-cleaning in that regard observations show. Further, the cut-through nature of hole 42 permits maximum usage of the thickness of plate portion 30 in the self-regeneration of stripping edges at confronting surface 40 when with prolonged usage and many strippings the original stripping edges wear. In this, it is believed that the inner wall surfaces also play an important role in the stripping action produced with device 26, as shall be explained. Most desirably, the surfaces of the inner wall portions adjacent the stripping edges should be linear along their width-wise direction from wrap-confronting surface 40 to outwardly facing surface 38, but along their lengthwise direction they may be arcuate, as in FIGS. 1 and 2, or be linear as in FIGS. 6 to 8, or be in part linear and in part arcuate as in FIG. 5. Choice of any particular shape, configuration and size of hole 42 and those of its stripping edges and inner walls, in accordance with these teachings, may readily be determined by one of skill in the art as those which are efficacious for any particular application to which device 26 is put.

In application of device 26 for the removal of underwindings U from member 22 of a spindle assembly, in contrast to applications wherein, for example, one may merely wish to strip yarn wraps from a cop, special structure is provided at certain outer peripheral surfaces of device 26 closest to threadline T. Such device 26 at its portion 30 intrudes into the space between member 22 and ring 14 and its attached traveller 16, when ring rail 20 has been lowered below collar 24 just prior to the doffing of yarn package P, yarn wraps U will encounter outer surface 38 of device 26 before being wrapped in full circle about member 22. Thus, in accordance with the invention, means are provided to permit yarn Y to slip over device 26 and wrap about member 22 for anchoring there. In this, a sloped edge 44 is provided on portion 30, sloping toward the rounded top 46 of portion 30 in the same direction as the movement of traveller 16 in front of device 26. Thus, as traveller 16 draws yarn Y across surface 38 and beyond under tension, yarn Y will be moved by that tension up sloped edge portion 44 and over top 46 of portion 30 and onto rotating member 22. Both top 46 and sloped edge 44 are rounded from surface 38 to surface 40 in order to prevent breakage or cutting of yarn Y as it passes thereover, such as by champfering. In ring spinning, as previously mentioned, either an "S" or a "Z" twist is imparted to yarn Y, as required by the end use intended for such yarn. In "S" twist spinning, blade 18, cop 12, package P, traveller 16, collar 24, and rotatable member 22 all rotate in an anti-clockwise direction when viewed from above or from the left to the right, as in FIGS. 1 and 2, whereas in "Z" twist yarn spinning such elements rotate in a clockwise manner when viewed from above, or from the right to the left when viewed from the aisle facing spindle assembly 10 as seen in FIG. 1. Thus, device 26 as shown with a double-sloped upper portion 30 in FIGS. 1, 5 and 6 is useful in either "S" or "Z" yarn twist underwindings' spinning; that shown in FIG. 7, which portion 30 is there viewed from the rear, is useful only in "Z" underwindings' spinning, whereas that of FIG. 8 is useful only in "S" underwindings' spinning, each respective portion 30 having but a single sloped edge 44 sloping as shown in opposite directions to one another. In order that yarn Y pass over top 46 of device 26, device 26 must be so mounted as to provide sufficient space between top 46 and the overhanging portion of cutter 24.

THEORY OF OPERATION OF THE INVENTION

When yarn wraps have been layered onto a rotatable member to accumulate to a depth either equal to or exceeding the distance from the stripping edges of the present device to the rotatable member, the device will with rotation of the member strip wraps therefrom to a depth less than such distance. If the device is positioned relative the member such that the distance of edges to the member are less than the depth of a single wrap of yarn, the member will be stripped of all yarn.

Yarn here considered is a somewhat tightly twisted strand of staple fibers. As such it has not only a lengthwise resilience but also a certain degree of widthwise resilience. In a plurality of overlapping wraps of such yarn, the mass possesses a "widthwise" resilience which is greater than the sum of the resiliencies of the individual yarns. It is upon these qualities that the present stripping device depends for its efficacious operation.

The present stripper abrades and also may cut the wraps, as the wraps are moved past the stripping edges of the central hole. Depending upon the width and contour of the surface of the stripper facing the wraps, such as where the surface may be arcuate to complement that of the rotatable member, the peripheral edges of the device also may encounter the wraps as they are rotated past the device. As the wraps move against the peripheral edge of the device first encountered, they are compressed. In such action the topmost wraps are abraded. If the confronting surface is planar and sufficiently wide such that the wraps do not encounter the peripheral edges, as the wraps encounter the confronting surface staple fibers are compressed, and in the action of movement along the surface are abraded in the scuffing. When the wraps encounter the first of the stripping edges of the central hole, the compressive forces are relieved, with at least a slight expansion of the fibers into the central hole space, forcing the fibers as they move into abutment with this stripping edge in a strongly abrasive scuffing action. If the edge is sufficiently sharp, even cutting may occur. The yarn fibers pass by the space portion in an expanded state, protruding into the hole. As these fibers then encounter the second stripping edge of the central hole, they are suddenly compressed, and bear against the edge strongly, in an abrasive scuffing; if the edge is sharp enough, the strands not only are abraded but may be cut through. At any event, with the rapid rotation of the wrap-bearing member, stripping of yarn wraps to a prescribed depth or less proceeds fairly rapidly.

In use of the device on a spindle assembly, it is usually desirable to maintain some underwindings on the rotatable member, at least until sufficient wraps of yarn have been layered upon the empty cop to form a firm anchor there for a stable yarn package to be built, and so that there will be no yarn slippage on the cop.

OTHER EMBODIMENTS

In accordance with the foregoing teachings, other embodiments from those shown and above described may prove desirable for use in particular applications. For example, the edges of the hole on the confronting surface 40 may form a triangle, or another shape such as a half or a quarter moon. In the former, one of the edges would be linear and the other hemicircular and in the latter both stripper edges would be arcuate but have different degrees of arcuity. Further, although the embodiment of FIGS. 4 and 5 are shown with arcuate confronting surfaces bearing the stripping edges which surfaces are complementary to those of the concave and convex surfaces of the rotatable member 22, the confronting surface may be arcuate in a widthwise direction from one side of the stripper device to the other for particular applications.

The device's hole may be thought of as being defined by the edges on the confronting surface, a pair of which are the stripping edges and which latter extend in the general direction of the axis of rotation of the rotatable member or, analagously, extend in the lengthwise direction of the device.

Having thus described preferred and other embodiments of the invention, its advantages and uses, one skilled in the art may readily think of yet other modifications and variations in contours, orientations, dimensions and applications which would fall within its definitions as now claimed.

That which is claimed is:

1. In combination with an element of circular cross-section for bearing wraps of yarn to be stripped therefrom, and a yarn stripper device mounted adjacent said element a prescribed distance therefrom, and means for rotating said element axially thereof, the improvement comprising said stripper device, comprising a rigid plate rigidly mounted, said plate being formed with a hole therethrough in the region adjacent said element, said hole being defined at the surface of said plate confronting said element by edges including a pair of edges extending generally in the direction of the axis of rotation of said element and being separated from one another a distance within the range of one-tenth of a radius length to one radius length of said element.

2. The improvement as in claim 1, wherein said confronting surface is planar.

3. The improvement as in claim 1, wherein said confronting surface is nonplanar.

4. The improvement as in claim 3, wherein said confronting surface is convex.

5. The improvement as in claim 3, wherein said confronting surface is concave.

6. The improvement as in claim 1, wherein said pair of edges are linear.

7. The improvement as in claim 1, wherein said pair of edges are nonlinear.

8. The improvement as in claim 1, wherein one of said pair of edges is linear and the other nonlinear.

9. The improvement as in claim 7, wherein said pair of edges are arcuate.

10. The improvement as in claim 9, wherein said edges are hemicircular.

11. The improvement as in claim 1, wherein said element is part of a vertically disposed ring yarn spinning spindle assembly fixed to a spindle rail, and is located beneath the spindle blade thereof, and wherein said stripper device is rigidly interconnected with said spindle rail.

12. A stripper device for removing yarn wraps from a rotatable element having a circular cross-section comprising a rigid plate being formed with a hole therethrough in a region thereof for facing said element, said hole being defined at the facing surface of said plate by edges comprising a pair of edges thereof extending generally in a lengthwise direction of said plate, and being separated from one another at their midpoints a distance within the range of one-tenth of a radius length to one radius length of said element.

13. A stripper device as in claim 12, wherein said facing surface is planar.

14. A stripper device as in claim 12, wherein said facing surface is nonplanar.

15. A stripper device as in claim 14, wherein said facing surface is convex.

16. A stripper device as in claim 14, wherein said facing surface is concave.

17. A stripper device as in claim 12, wherein said pair of edges are linear.

18. A stripper device as in claim 12, wherein said pair of edges are nonlinear.

19. A stripper device as in claim 18, wherein said edges are arcuate.

20. A stripper device as in claim 12, wherein said edges are hemicircular.

21. A stripper device as in claim 12, wherein one of said edges is linear and another nonlinear.

22. A stripper device as in claim 12, wherein said edges form an oval.

23. A stripper device as in claim 12, wherein said edges form a quadrilateral.

24. A stripper device as in claim 23, wherein said quadrilateral is a rectangle.

* * * * *